US005276227A

United States Patent [19]

Wu et al.

[11] Patent Number: 5,276,227

[45] Date of Patent: * Jan. 4, 1994

[54] $C_2$-$C_5$ OLEFIN OLIGOMER COMPOSITIONS AS SHEAR STABLE VISCOSITY INDEX IMPROVERS

[75] Inventors: Margaret M. Wu, Skillman; Alice S. Chu, Spotswood, both of N.J.

[73] Assignee: Mobil Oil Corporation, Fairfax, Va.

[ * ] Notice: The portion of the term of this patent subsequent to Feb. 5, 2008 has been disclaimed.

[21] Appl. No.: 829,816

[22] Filed: Feb. 3, 1992

[51] Int. Cl.[5] ..... C10L 1/16

[52] U.S. Cl. ..... 585/12; 585/10; 585/11; 585/17; 585/19; 585/411; 585/452; 208/18; 208/19

[58] Field of Search ..... 585/10, 12, 18, 17; 208/18, 19

[56] References Cited

U.S. PATENT DOCUMENTS

| | | | |
|---|---|---|---|
| 4,827,064 | 5/1989 | Wu | 585/12 |
| 4,827,073 | 5/1989 | Wu | 585/12 |
| 4,990,709 | 2/1991 | Wu | 585/10 |
| 5,012,020 | 4/1991 | Jackson et al. | 585/12 |
| 5,068,476 | 11/1991 | Wu et al. | 585/12 |
| 5,146,021 | 9/1992 | Jackson et al. | 585/12 |
| 5,157,177 | 10/1992 | Pelrine et al. | 585/12 |

*Primary Examiner*—Asok Pal

*Attorney, Agent, or Firm*—A. J. McKillop; M. D. Keen

[57] ABSTRACT

Liquid hydrocarbon lubricant viscosity index improver compositions are disclosed having high shear stability. The compositions comprise the homopolymer or copolymer product of the oligomerization of $C_3$ to $C_5$ alpha-olefin or mixtures thereof, with or without ethylene as co-monomer. The process is carried out under oligomerization conditions in contact with a reduced valence state Group VIB metal catalyst on porous support. The viscosity index improver of the invention has a regio-irregularity of at least 20%, weight average molecular weight between 6,000 and 30,000 and molecular weight distribution between 2 and 5.

21 Claims, No Drawings

$C_2$–$C_5$ OLEFIN OLIGOMER COMPOSITIONS AS SHEAR STABLE VISCOSITY INDEX IMPROVERS

FIELD OF THE INVENTION

This invention relates to viscosity index (VI) improver compositions and to a process for their production by the oligomerization of $C_2$–$C_5$ alpha-olefins. In particular, the invention relates to a process for the homopolymerization or copolymerization of $C_2$–$C_5$ alpha-olefins using reduced chromium oxide on a solid support as catalyst to produce oligomer compositions comprising VI improvers having high shear stability. The invention includes novel lubricants blends containing these shear stable VI improvers. The VI improvers (VII) in this invention produce formulated engine oils with unexpectedly better low temperature viscometrics. These new VI improvers permit the formulation of wider cross-graded engine oil.

BACKGROUND OF THE INVENTION

Efforts to improve upon the performance of natural mineral oil based lubricants by the synthesis of oligomeric hydrocarbon fluids have been the subject of important research and development in the petroleum industry for at least fifty years and have led to the relatively recent market introduction of a number of superior polyalpha-olefin (PAO) synthetic lubricants, primarily based on the oligomerization of alpha-olefins or 1-alkenes. In terms of lubricant property improvement, the thrust of the industrial research effort on synthetic lubricants has been toward fluids exhibiting useful viscosities over a wide range of temperature, i.e., improved viscosity index (VI), while also showing lubricity, thermal and oxidative stability and pour point equal to or better than mineral oil. These new synthetic lubricants lower friction and hence increase mechanical efficiency across the full spectrum of mechanical loads from worm gears to traction drives and do so over a wider range of operating conditions than mineral oil lubricants.

In accordance with customary practice in the lubricant arts, PAO's have been blended with a variety of additives such as functional chemicals, oligomers and high polymers and other synthetic and mineral oil based lubricants to confer or improve upon lubricant properties necessary for applications such as engine lubricants, hydraulic fluids, gear lubricants, etc. Blends and their additive components are described in Kirk-Othmer Encyclopedia of Chemical Technology, third edition, volume 14, pages 477–526, incorporated herein in its entirety by reference. A particular goal in the formulation of blends is the enhancement of viscosity index (VI) by the addition of VI improvers which are typically high molecular weight synthetic organic molecules. Such additives are commonly produced from polyisobutylenes, polymethacrylates and polyalkylstyrenes, and used in the molecular weight range of about 45,000 to about 1,700,000. While effective in improving viscosity index, these VI improvers have been found to be deficient in that the very property of high molecular weight that makes them useful as VI improvers also confers upon the blend a vulnerability in shear stability during actual applications. This deficiency dramatically reduces the range of usefulness applications for many VI improver additives. VI enhancers more frequently used are high molecular weight acrylics. Their usefulness is further compromised by cost since they are relatively expensive polymeric substances that may constitute a significant proportion of the final lubricant blend. Accordingly, workers in the lubricant arts continue to search for additives to produce better lubricant blends with high viscosity index. However, VI improvers and lubricant mixtures containing VI improvers are preferred that are less vulnerable to viscosity degradation by shearing forces in actual applications. Preferred liquids are those that exhibit Newtonian behavior under conditions of high temperature and high shear rate, i.e., viscosities which are independent of shear rate.

Recently, novel lubricant compositions (referred to herein as HVI-PAO and the HVI-PAO process) comprising polyalpha-olefins and methods for their preparation employing as catalyst reduced chromium on a silica support have been disclosed in U.S. patent applications Ser. No. 210,434 and 210,435 filed Jun. 23, 1988, now U.S. Pat. Nos. 4,827,064 and 4,827,023 to M. Wu, incorporated herein by reference in their entirety. The process comprises contacting $C_6$–$C_{20}$ 1-alkene feedstock with reduced valence state chromium oxide catalyst on porous silica support under oligomerizing conditions in an oligomerization zone whereby high viscosity, high VI liquid hydrocarbon lubricant is produced having branch ratios of less than 0.19 and pour point below −15 ° C. The process is distinctive in that little isomerization of the olefinic bond occurs compared to known oligomerization methods to produce polyalpha-olefins using Lewis acid catalyst. Their very unique structure provides opportunities for the formulation of superior lubricant blends.

Considering the abundance of $C_2$ to $C_5$ alpha-olefins in the petroleum refinery, and their low cost, it has long been been recognized that they could be a preferred source of low cost lubricant if they could be oligomerized to provide high viscosity index lubricant in good yield with a manageable, regenerable, non-corrosive catalyst such as reduced chromium on porous support as taught in the foregoing patents to M. Wu. These objectives are taught and reached in the process and compositions of U.S. Pat. No. 4,990,709. The products of the process taught in U.S. Pat. 4,990,709 exhibit a very unique structure that confers upon the products the properties of novel compositions. In conventional Ziegler oligomerization of alpha olefins it is well known in the art that the oligomers produced contain a high degree of structural regularity, or regio-regularity, as exhibited by a preponderance of head-to-tail bonding in the oligomerization of these alpha olefins. In the products from Ziegler catalyzed oligomerization not more than twenty percent of the repeating units are linked by head-to-head and tail-to-tail bonding. In the olefin oligomers produced from the reduced metal oxide catalysts taught in the patents to M. Wu it has been found that at least forty percent of the repeating units are bonded by head-to-head or tail-to-tail connections. The oligomers contain not more than 60% regio-regularity, where 100% regio-regularity corresponds with all head-to-tail connections for the recurring oligomeric unit. At least twenty percent of the repeating units are bonded by irregular head-to-head or tail-to-tail connections. These oligomers have a regio-irregularity of at least twenty percent, usually from 20 to 40 percent, and in most cases, not more than 60 percent.

Accordingly, it is an object of the present invention to provide novel, low viscosity lubricant VI improver compositions having high viscosity index and shear stability from alpha-olefins.

It is a further object of the present invention to provide novel lubricant basestock blends from low viscosity, high viscosity index $C_2$–$C_5$ copolymers or homopolymers in conjunction with synthetic and natural petroleum lubricant.

SUMMARY OF THE INVENTION

The present invention comprises liquid hydrocarbon lubricant viscosity index improver compositions having higher shear stability. The compositions comprise homopolymer or copolymer product of the oligomerization of $C_3$ to $C_5$ alpha-olefin or mixtures thereof, with or without ethylene as comonomer. The process is carried out under oligomerization conditions in contact with a reduced valence state Group VIB metal catalyst on porous support. The viscosity index improver of the invention has a regio-irregularity of at least 20%, weight average molecular weight between 6,000 and 30,000 and molecular weight distribution between 2 and 5.

The liquid viscosity index (VI) improver of the present invention produced from oligomerization of $C_3$ to $C_5$ alpha olefins, alone or in a mixture with ethylene, has superior VI boosting power compared to other oligomers such as HVI-PAO or low molecular weight basestocks produced by oligomerization of $C_3$ to $C_5$ alpha olefins, alone or mixed with ethylene, over activated chromium on silica catalyst. The shear stable VI improvers of this invention are also employed to formulate lubricant oil with unexpected low temperature properties, thus allowing the formulation of broader cross grade, shear stable engine oils. These unique properties distinguish the products of this invention from those in the above referenced U.S. Pat. No. 4,990,709.

The invention includes shear stable liquid lubricant compositions comprising a blend of hydrocarbon lubricant basestock and viscosity index improving amount of the oligomer compositions of the invention. The blends contain between 2 and 25 percent of the oligomer compositions and have a shear stability of at least 97%.

Reference is made to U.S. Pat. No. 4,990,709 for a description of the process of the invention.

DETAIL DESCRIPTION OF THE INVENTION

In the following description, unless otherwise stated, all references to properties of oligomers or lubricants of the present invention refer as well to products of low unsaturation, as characterized by low bromine number, usually lower than 4. If the product has high number-averaged molecular weight (>4,000), then no hydrogenation is needed. If the product has number averaged molecular weight much lower than 4000, then hydrogenation is carried out in keeping with the practice well known to those skilled in the art of lubricant production.

In the present invention it has been found that $C_2$–$C_5$ alpha-olefins can be oligomerized to provide unique products using the process for the oligomerization of alpha olefins referenced herein before. The novel oligomers of the referenced invention, or high viscosity index polyalphaolefins (HVI-PAO) are unique in their structure compared with conventional polyalphaolefins (PAO) from 1-decene, for example. Polymerization with the novel reduced chromium catalyst described hereinafter leads to an oligomer substantially free of double bond isomerization. Conventional PAO, on the other hand, promoted by $BF_3$ or ALCl3 forms a carbonium ion which, in turn, promotes isomerization of the olefinic bond and the formation of multiple isomers. The HVI-PAO produced in the referenced invention has a structure with a $CH_3/CH_2$ ratio <0.19 compared to a ratio of >0.20 for PAO. Now it has been found that ethylene, propylene, 1-butene or 1-pentene, or mixtures thereof, can also be oligomerized with reduced chromium under conditions yielding valuable gasoline, distillate and superior lubricant range products in good yield.

The $C_2$–$C_5$ feedstocks used in the present invention are particularly inexpensive and common materials found in the petroleum refinery complex. Readily available sources include fluid catalytic cracker operation; in particular, the product of FCC unsaturated gas plant. The olefins are also available from the various steam cracking processes, e.g., light naphtha or LPG.

The mixtures of propylene, 1-butene or 1-pentene and ethylene can be used in a molar ratio from 100:1 to 0.1:1 ($C_3$–$C_5$:$C_2$), with a preferred molar ratio from about 10:1 to 0.2:1, in most cases from 5:1 to 0.3:1, for example, about 0.67:1 ($C_3$–$C_5$: $C_2$).

In the oligomerization of propylene, 1-butene or 1-pentene, the alpha-olefin can be used either in pure form or diluted with ethylene or other inert materials for production of the oligomers. The liquid products, after hydrogenation to remove unsaturation have higher viscosity indices than similar alpha-olefins oligomerized by conventional acid catalysts such as aluminum chloride or boron trifluoride.

To produce oligomers according to this invention for use as VI improvers, low reaction temperatures, e.g. 0 to 90° C., are appropriate. Similar temperature ranges are also used to produce copolymers with ethylene and $C_3$–$C_5$ alpha-olefins. Generally, temperatures between 90° and 250° C. are used for the synthesis of lubricant basestock such as ethylene-propylene copolymer while temperatures below 90° C. are used to synthesize the VI improvers if the present invention.

This new class of alpha-olefin oligomers referenced above are prepared by oligomerization reactions in which a major proportion of the double bonds of the alpha-olefins are not isomerized. These reactions include alpha-olefin oligomerization by supported metal oxide catalysts, such as Cr compounds on silica or other supported IUPAC Periodic Table Group VIB compounds. The catalyst most preferred is a lower valence Group VIB metal oxide on an inert support. Preferred supports include silica, alumina, titania, silica alumina, magnesia and the like. The support material binds the metal oxide catalyst. Those porous substrates have a pore opening of at least 40 angstroms are preferred.

The support material usually has high surface area and large pore volumes with average pore size of 40 to about 350 angstroms. The high surface area are beneficial for supporting large amount of highly dispersive, active chromium metal centers and to give maximum efficiency of metal usage, resulting in very high activity catalyst. The support should have large average pore openings of at least 40 angstroms, with an average pore opening of >60 to 300 angstroms preferred. This large pore opening will not impose any diffusional restriction of the reactant and product to and away from the active catalytic metal centers, thus further optimizing the catalyst productivity. Also, for this catalyst to be used in fixed bed or slurry reactor and to be recycled and regenerated many times, a porous support with good physical strength is preferred to prevent catalyst particle attrition or disintegration during handling or reaction.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO, $H_2$, $NH_3$, $H_2S$, $CS_2$, $CH_3SCH_3$, $CH_3SSCH_3$, metal alkyl containing compounds such as $R_3Al$, $R_3B$, $R_2Mg$, RLi, $R_2Zn$, where R is alkyl, alkoxy, aryl and the like. Preferred are CO or $H_2$ or metal alkyl containing compounds. Alternatively, the Group VIB metal may be applied to the substrate in reduced form, such as CrII compounds. The resultant catalyst is very active for oligomerizing olefins at a temperature range from below room temperature to about 250° C. at a pressure of 0.1 atmosphere to 5000 psi. Contact time of both the olefin and the catalyst can vary from one second to 24 hours. The catalyst can be used in a batch type reactor, a continuous stirred tank reactor or in a fixed bed, continuous-flow reactor.

In general the support material may be added to a solution of the metal compounds, e.g., acetates or nitrates, etc., and the mixture is then mixed and dried at room temperature. The dry solid gel is purged at successively higher temperatures to about 600° for a period of about 16 to 20 hours. Thereafter the catalyst is cooled down under an inert atmosphere to a temperature of about 250° to 450° C. and a stream of pure reducing agent, such as CO, is contacted therewith. When enough CO has passed through to reduce the catalyst there is a distinct color change from bright orange to pale blue. Typically, the catalyst is treated with an amount of CO equivalent to a two-fold stoichiometric excess to reduce the catalyst to a lower valence CrII state. Finally the catalyst is cooled down to room temperature and is ready for use.

Supported Cr metal oxide in different oxidation states is known to polymerize alpha olefins from $C_3$ to $C_{20}$ (De 3427319 to H. L. Krauss and Journal of Catalysis 88, 424–430, 1984) using a catalyst prepared by $CrO_3$ on silica. As reported by H. L. Krauss, the catalyst is reactive for ethylene and alpha olefin copolymeriation. For ethylene polymerization according to the Krauss process over $CrO_3$ on silica catalyst only trace amounts of solid material was produced. In the instant invention, very high activity for ethylene polymerization or ethylene and alpha olefin copolymerization is observed. The present invention produces medium to high molecular weight oligomeric products under reaction conditions and using catalysts which minimize side reactions such as 1-olefin isomerization, cracking, hydrogen transfer and aromatization. The catalysts used in the present invention do not cause a significant amount of side reactions even at high temperature when oligomeric, low molecular weight fluids are produced.

The catalysts for this invention thus minimize all side reactions but oligomerize olefins including ethylene and alpha olefins to give medium molecular weight polymers with high efficiency. It is well known in the prior art that chromium oxides, especially chromia with average +3 oxidation states, either pure or supported, catalyze double bond isomerization, dehydrogenation, cracking, etc. Although the exact nature of the supported Cr oxide is difficult to determine, it is thought that the catalyst of the present invention is rich in Cr(II) supported on silica, which is more active to catalyze alpha-olefin oligomerization at high reaction temperature without causing significant amounts of isomerization, cracking or hydrogenation reactions, etc. However, catalysts as prepared in the cited references can be richer in Cr (III). They catalyze alpha-olefin polymerization at low reaction temperature to produce high molecular weight polymers. However, as the references teach, undesirable isomerization, cracking and hydrogenation reaction takes place at higher temperatures. In contrast, high temperatures are needed in this invention to produce lubricant products. The prior art also teaches that supported Cr catalysts rich in Cr(III) or higher oxidation states catalyze 1-butene isomerization with $10^3$ higher activity than polymerization of 1-butene. The quality of the catalyst, method of preparation, treatments and reaction conditions are critical to the catalyst performance and composition of the product produced and distinguish the present invention over the prior art.

In the instant invention very low catalyst concentrations based on feed, from 10 wt % to 0.01 wt %, are used to produce oligomers; whereas, in the cited references catalyst ratios based on feed of 1:1 are used to prepare high polymer. Resorting to lower catalyst concentrations in the present invention to produce lower molecular weight material runs counter to conventional polymerization theory, compared to the results in the cited references.

The oligomers of 1-olefins prepared in this invention usually have much lower molecular weights than the polymers produced in cited reference which are semi-solids, with very high molecular weights, and are not suitable as lubricant basestocks or VI improvers. Furthermore, the products in this invention can tolerate some amount of ethylene which is beneficial for its VI improving properties. However, in the work of Krauss, ethylene is almost inert. These high polymers also have very low unsaturations. However, products in this invention are free-flowing liquids at room temperature, suitable for lube basestock and VI improvers.

In Table 1 the results of the spectroscopic determination of the regio-regularity of the products of the present invention are presented (nos. 3–5) as well as the results from the products of 1-decene and 1-hexene oligomerization. The C-13 NMR spectra and the INEPT (Insensitive Nuclei Enhancement by Polarization Transfer) spectra of four products prepared from Cr/Si02 catalyzed HVI-PAO oligomerization process reactions of 1-decene, 1-hexene, 1-butene and propene are presented. For each oligomer, the chemical shifts of the methylene and methine carbons of the backbone are calculated and assigned based on different combinations of regio-irregularity. From the 2/4J INEPT spectrum which selectively detects only the methine carbons, the amount of regio-regularity of each oligomer is estimated. Entries 1–4 compare four different alpha-olefins as the starting material. The results indicate that the oligomers from the higher olefins are formed in a more regio-regular fashion than the lower olefins.

TABLE 1

| No. | Starting Olefin | Viscosity @ 100° C., cS | % Regio-Regularity |
|---|---|---|---|
| 1 | 1-decene | 145.0 | >58 |

TABLE 1-continued

| No. | Starting Olefin | Viscosity @ 100° C., cS | % Regio-Regularity |
|---|---|---|---|
| 2 | 1-hexene | 92.8 | ~51 |
| 3 | 1-butene | 103.7 | ~48 |
| 4 | propene | 95.3 | ~41 |
| 5 | 1-butene | 2.8 | ~38 |

The process and products of the present invention are illustrated in the following the Examples.

EXAMPLE 1

Catalyst Preparation and Activation Procedure 1.9 grams of chromium (II) acetate ($Cr_2(OCOCH_3)_4 2H_2O$) (5.58 mmole) (commercially obtained) is dissolved in 50 cc of hot acetic acid. Then 50 grams of a silica gel of 8-12 mesh size, a surface area of 300 $m^2/g$, and a pore volume of 1 cc/g, also is added. Most of the solution is absorbed by the silica gel. The final mixture is mixed for half an hour on a rotavap at room temperature and dried in an open-dish at room temperature. First, the dry solid (20 g) is purged with $N_2$ at 250° C. in a tube furnace. The furnace temperature is then raised to 400° C. for 2 hours. The temperature is then set at 600° C. with dry air purging for 16 hours. At this time the catalyst is cooled down under $N_2$ to a temperature of 300° C. Then a stream of pure CO (99.99% from Matheson) is introduced for one hour. Finally, the catalyst is cooled down to room temperature under $N_2$ and ready for use.

EXAMPLE 2

A $Cr/SiO_2$ catalyst was prepared as described in Examples 1. Three grams of the activated $Cr/SiO_2$ catalyst was packed in a fixed bed down flow reactor of ⅜" id. Propylene of 5 gram per hour was reacted over the catalyst bed heated to 180°-190° C. and at 220 psig. After 16 hours, 56.2 gram of liquid product and 24.9 gram of gas were collected. The gas product analyzed by gc contained 95% propylene. The liquid product had the following compositions:

| | $C_6$ | $C_9$ | $C_{12}$ | $C_{15}$ | $C_{18}$ | $C_{21}$ | $C_{24}$ | $C_{27}$ | $C_{30}+$ |
|---|---|---|---|---|---|---|---|---|---|
| wt % | 10.6 | 11.2 | 8.6 | 7.4 | 3.3 | 3.9 | 2.9 | 3.9 | 48.3 |

The products from $C_6$ to $C_{12}$, after hydrogenation, can be used as gasoline components. The products from $C_{12}$ to $C_{24}$ can be used as distillate components. The unhydrogenated lube product, most $C_{27}$ and higher hydrocarbons and isolated after distillation at 180° C./0.1 mm Hg, have viscosity at 100° C. of 28.53 cS and VI of 78. The unhydrogenated lube product had higher VI than the same viscosity oil produced from propylene by $AlCl_3$ or $BF_3$ catalyst, as summarized below.

| Catalyst | Unhydrogenated lube yield | V @ 100 C., cS | VI |
|---|---|---|---|
| $AlCl_3/HCl$ | 87 | 29.96 | 38 |
| $BF_3H_2O$ | 23 | 7.07 | 46 |

The unhydrogenated lube product from $Cr/SiO_2$ catalyst has simpler C13-NMR spectrum than lube by acid catalyst.

EXAMPLE 3

The procedure of Example 2 was followed, except that the reaction was run at 170° C. and 300-400 psig. After 14 hours reaction, 47.5 grams liquid and 18.4 g gas (mostly propylene) were collected. The liquid product had the following composition, analyzed by gc:

| $C_6$ | $C_9$ | $C_{12}$ | $C_{15}$ to $C_{20}$ | $C_{20}$ to $C_{30}$ | $C_{30}+$ |
|---|---|---|---|---|---|
| 4.51 | 5.53 | 5.01 | 12.22 | 5.30 | 67.43 |

The unhydrogenated lube fraction after distillation to remove light end at 160° C./0.1 mm Hg, had viscosity at 100° C. of 39.85 and VI of 81.

EXAMPLE 4

A $Cr/SiO_2$ catalyst was prepared as in Example 1.

To a tubular reactor packed with three grams of 1% Cr on silica catalyst, propylene of 5 g/hr and ethylene 1.13 g/hr (Molar ratio of $C_3/C_2=3$) were fed through at 190° C. and 200-300 psig. The liquid product weighed 68 grams, after 15 hours on stream. This once-through liquid yield was 75%. The gas contained ethylene and propylene which can be recycled. The liquid product was centrifuged to remove the small amount of solid particles. The clear liquid was fractionated to give 50% light fraction boiling below 145° C. at 0.01 mmHg and 50% unhydrogenated lube product. The unhydrogenated lube product had V@100 (viscosity at 100° C.)=46.03 cS, V@40 (viscosity at 40° C.)=703.25 cS and VI=112. The light fractions are unsaturated olefinic hydrocarbons with six to 25 carbons. The ir showed the presence of internal and vinylidene double bonds. These olefins can be used as starting material for synthesis of other value-added products, such as detergents, additives for lube or fuel. These light fractions can also be used as gasoline or distillates.

This example demonstrates that one can produce lube with high VI from ethylene and propylene mixture over an activated Cr on silica catalyst. The light product can be useful as chemicals or fuel.

EXAMPLE 5

The run in Example 2 was continued for another 23 hours and 78 grams liquid product was collected. The once-through liquid yield was 54%. This liquid product was centrifuged to remove the solid precipitate. The clear product was fractionated to give 35% light liquid boiling below 145° C. at 0.1 mmHg and 65% viscous unhydrogenated lube product. The unhydrogenated lube product had V@100=72.40 cS, V@40 =980.73 cS and VI=144.

EXAMPLE 6

The reactor, propylene and ethylene feed rates were the same as in Example 4. In addition, n-octane was fed through the reactor at 10 cc/hr as solvent at 185° C. After 17 hours on stream, 228 grams of liquid product was collected. Material balance indicated that all ethylene and propylene was converted into liquid product. The liquid, after filtering off trace solid, was fractionated to give four fractions:

Fraction 1, boiling below 130° C., 118 g, mostly n-octane solvent;

Fraction 2, up to 123 C./0.01 mmHg, 32 g.;

Fraction 3, up to 170 C./0.01 mmHg, 27 g; and

Fraction 4, residual product, 40 g.

Fraction 4 has the following viscometric properties: V@100 =30.99 cS, V@40 =343.44 cS, VI=126.

This Example demonstrates that the presence of an inert solvent is advantageous to produce lower viscosity lube. The presence of an inert solvent also prevents the reactor from plugging by trace solid formation.

EXAMPLE 7

This Example illustrates the preparation of polypropylene liquid product using both a reduced metal catalyst (Ex. 7A) and a Ziegler catalyst (Ex. 7B).

EXAMPLE 7A

An activated chromium on silica catalyst (15 grams) and purified n-decane (400 cc) were charged into an one-liter autoclave with stirring under nitrogen atmosphere. When the autoclave temperature reached 160° C., liquid propylene was fed at 50 cc/hr until 375 cc was charged into the reactor. After 16 hours at 160° C., the slurry product was discharged, filtered to remove solid catalyst and distilled up to 120° C. at 0.1 mmHg vacuum to remove light ends. The product yields and properties are summarized in Table 2.

EXAMPLE 7B

Preparation of polypropylene liquid product by Ziegler catalyst, ZrCp2C12/MAO.

A solution catalyst containing 0.17 mmole zirconocene dichloride and 88 mole methylaluminoxane in 150 cc toluene was add to an one-liter autoclave at 25° C. Propylene was then added at 50 cc/hr until 375 cc was charged into the reactor. After 16 hours, the catalyst components were deactivated by adding 1 cc water. The liquid product was isolated by drying and filtration to remove solid components. The lube product was isolated as in Example 7A. The product yields and properties are summarized in Table 2 below.

The polymer structures produced by the use of the chromium catalyst are uniquely irregular. The C13 NMR spectra of these two examples indicated that the chromium product of Example 7A is much less regular than the Ziegler product of Example 7B. The amount of this regio-irregularity can be determined by the C-13 2/4J INEPT (Insensitive Nuclei Enhancement by Polarization Transfer) NMR technique. The INEPT spectra of the products of Examples 7A and 7B showed the different types of the methine carbons in the backbones of chromium product and the Ziegler product.

The data in Table 2 show that the chromium product had better thermal stability than the regular Ziegler product, when cracked at 280° C. under nitrogen atmosphere for 24 hours.

EXAMPLE 8

Preparation of poly-1-butene liquid products, using a reduced metal catalyst (Ex. 8A) and a Ziegler catalyst (Ex. 8B).

EXAMPLE 8A

Poly-1-butene was produced in a continuous, downflow fixed bed reactor. The reactor was constructed of ⅜" o.d. stainless steel tube. The bottom of the reactor contained 18 grams of clean 14/20 mesh quartz chips, supported on a coarse frit of 6 mm diameter. Three gram activated chromium catalyst was charged into the tube. The top of the reactor tube was packed with quartz chips to serve as a feed preheater. The reactor tube was wrapped with a heat-conducting jacket. The reactor temperature, 125° C., was measured and controlled with a thermocouple located at the middle of the jacket. 1-Butene liquid was pumped through a 50 cc Hoke bomb packed with Deox and 13X molecular sieve of equal volume to remove oxygenates and water contaminants. 1-Butene was fed into the reactor from the top. Reactor pressure, 320 psig, was controlled by a grove-loader at the reactor outlet. The effluent was collected at the reactor bottom and the lube product was isolated by distillation up to 140° C. at 0.1 mmHg vacuum. The product properties are summarized in Table 2.

EXAMPLE 8B

Preparation of poly-1-butene liquid product by Ziegler catalyst, ZrCp2C12/MAO

The product was prepared as in Example 7B, except 1-butene was used as feed. The product yield and properties are summarized in Table 2.

The C13 NMR spectra of the two products of Examples 8A and 8B show that the chromium product of Example 8A is much less regular than the Ziegler product of Example 8B as well, by comparison with spectra reported in the literature for Ziegler polymers. The data in Table 2 show that the chromium product of Example 8A had better thermal stability than the regular Ziegler product of Example 8B, when cracked at 280° C. under nitrogen atmosphere for 24 hours.

EXAMPLE 9

Preparation of ethylene/propylene copolymer, using a reduced metal catalyst and a Ziegler catalyst.

Example 9A

As Example 7A, except gaseous ethylene (25.2 g/hr) and propylene (25 g/hr) were fed simultaneously into the autoclave at 185° C. The product yield and properties are summarized in Table 2.

EXAMPLE 9B

Preparation of ethylene/propylene copolymer liquid product by Ziegler catalyst, ZrCp2C12/MAO As Example 7B, except ethylene (25.2 g/hr) and propylene (25 g/hr) were fed simultaneously into the autoclave at 60° C. The product yield and properties are summarized in Table 2. The C13 NMR spectra of the products indicated that the chromium product of Example 9A is much less regular than the Ziegler product of Example 9B.

TABLE 2

| Example No. | 7A | 7B | | 8A | 8B | 9A | 9B |
|---|---|---|---|---|---|---|---|
| Feed | ----C3=---- | | | ---1-C4=--- | | --C2=/C3=-- | |
| Catalyst | Cr/SiO2 | Zr/MAO | | Cr/SiO2 | Zr/MAO | Cr/SiO2 | Zr/MAO |
| Yield, wt % | 55 | 48 | 79 | 86 | 75 | 88 | >80 |
| Properties: | | | | | | | |
| V @ 100° C., cs | 95.27 | 62.37 | 157.2 | 115.15 | 192.62 | 51.69 | 61.09 |
| VI | 82 | 59 | 105 | 91 | 123 | 154 | 173 |

TABLE 2-continued

| Example No. | 7A | 7B | 8A | 8B | 9A | 9B |
|---|---|---|---|---|---|---|
| Thermal Stab. % Viscosity Loss at 280° C. | 31 | — 69 | 41 | 67 | — | — |
| $MW_n$*, number avg. MW | | | 1295 | | 1432 | 581 |
| $MW^w$*, wgt. avg. MW | | | 3070 | | 3632 | 3664 |
| MWD | | | 2.37 | | 2.54 | 2.32 |

Note:
*Molecular weights of these samples were obtained by GPC calibrated to polystyrene standards.

EXAMPLE 10

A polypropylene liquid product was prepared using a reduced metal catalyst, in a similar manner to Example 7A, except the autoclave was heated to 80° C. The product yield and properties are summarized in Table 3 below.

EXAMPLE 11

An ethylene/propylene copolymer liquid was prepared as described in Example 10, except ethylene (16.7 g/hr) and propylene (25g/hr) were fed simultaneously into the autoclave at 95° C. The product yield and properties are summarized in Table 3.

TABLE 3

| Product Yields and Properties of Example 10 and 11 | | |
|---|---|---|
| | Example 10 | Example 11 |
| Catalyst | $Cr/SiO_2$ | Cr/SiOc |
| Feed | C3= | C2=/C3= |
| Yield | — | — |
| Product properties | | |
| MWn | 3900 | 4880 |
| MWD | 2.74 | 2.85 |

The estimated amounts of regio-irregularity of these products together with the reported data from the products obtained by Ziegler catalysts are summarized in Table 4.

TABLE 4

| Product Regio-Irregularity | | | |
|---|---|---|---|
| Sample | Catalyst | MWn | Mole % of irregular propylene |
| Example 7A | $Cr(II)/SiO_2$ | 1532 | 37 |
| Example 10 | $Cr(II)/SiO_2$ | 3900 | 21 |
| Reference* | $V(mmh)_3/AlEt_2Al$ | 3900 | 14 |
| Reference* | $TiCl_4MgCl_2/AlEt_2Al$ | — | 4 |
| Reference* | $Ti(OBu)_4MgCl_2/ATEt_2Al$ | 8 | |
| Example 7B | $ZrCp_2Cl_2/MAO$ | 400 | <5 |

*Y. Doi et al., "C13-NMR Chemical Shift of Regio-Irregular Polypropylene" Macromolecules 20 616-620 (1987).

As these results show, the polypropylenes by chromium catalyst have much higher amounts of regio-irregularity than products by other catalysts. These unique structure features are responsible for its better thermal stability as shown above.

The C3–C5 homo-polymer or co-polymer with ethylene can be used as blending components with mineral oil or low viscosity synthetic lubricants to improve viscosities and VIs. The blending results with mineral oil or synthetic oil are summarized in Table 5 below. As these blending examples show, products from Example 10 and 11 improve the oil viscosity and VI. The products of Examples 10 and 11 have low molecular weights, in the range of thousands and may therefore be expected to have much better shear stabilities than comparable polymers of higher molecular weight.

TABLE 5

| Blending Results with oils | | | |
|---|---|---|---|
| Blending Stock | V, 100° C., cS | V, 40° C., cS | VI |
| Mineral Oil | 4.19 | 21.32 | 97 |
| 10% Ex. 10 product | 9.44 | 60.19 | 138 |
| 10% Ex. 11 product | 19.48 | 128.74 | 173 |
| Synthetic oil | 5.61 | 28.94 | 136 |
| 10% Ex. 10 product | 10.70 | 67.09 | 149 |
| 10% Ex. 10 product | 16.93 | 108.34 | 170 |
| 5% Ex. 11 product | 8.09 | 46.36 | 148 |
| 5% Ex. 11 product | 10.50 | 58.56 | 170 |

It has been discovered that the process of the invention for the oligomerization of $C_3$–$C_5$ 1-olefins as homopolymer or as copolymer with ethylene provides a superior viscosity index improver. The VI improver has lower molecular weight than conventional VI improver but has a high viscosity index. Accordingly, the VI improvers show a remarkably high shear stability at high temperature when blended with synthetic lubricants or with mineral oil based lubricants. The following Examples illustrate the preparation and properties of these unique VI improvers using ethylene-propylene copolymer (EPC).

EXAMPLE 12

Synthesis of EPC VI Improver

An activated chromium on silica catalyst (15 gram) and purified n-decane (400 cc) were charged into a one-liter autoclave heated to the reaction temperature. Ethylene and propylene were fed into the stirred autoclave at controlled feed rates until 250 cc propylene was fed into the reactor. The reactor was stirred at reaction temperature overnight. The product was isolated by filtration to remove the solid catalyst. Part of the product was also centrifuged to remove the solid waxy component. The reaction conditions and product properties were summarized in Table 6.

TABLE 6

REACTION CONDITIONS AND BLENDING PRODUCT PROPERTIES OF EPC VI IMPROVERS.

| Sample No | EPC-1 | EPC-2 | EPC-3 | EPC-4 | *Comparative |
|---|---|---|---|---|---|
| Reaction Conditions | | | | | |
| Temperature, °C. | 95 | " | 80 | 55 | |
| Pressure, psig | 100 | " | 0 | 0 | |
| Time, hours | 16 | " | 16 | 16 | |
| Feed Rate, g/hr | | | | | |
| Ethylene | 16.7 | 16.7 | 0 | 0 | |
| Propylene | 25 | 25 | 50 | 50 | |
| $C_2/C_3$ Molar Ratio | 1 | 1 | 0 | 0 | |

TABLE 6-continued

REACTION CONDITIONS AND BLENDING PRODUCT PROPERTIES OF EPC VI IMPROVERS.

| Sample No | EPC-1 | EPC-2 | EPC-3 | EPC-4 | *Comparative |
|---|---|---|---|---|---|
| Work-up by | | | | | |
| Filtration | yes | yes | no | no | |
| Centrifuge | no | yes | yes | yes | |
| Wt % gel | 0 | 10.2 | 16 | 15 | |
| Product Molecular Weights by GPC | | | | | |
| MWn | 4884 | 6514 | 3933 | 8111 | |
| MWw | 13921 | 16441 | 10764 | 22053 | |
| MWD | 2.85 | 2.52 | 2.74 | 2.72 | |
| Product Properties of Blends, 5 wt % in Stock 509 | | | | | |
| V @ 100° C., cS | 10.2 | 10.5 | 7.67 | 9.58 | 7.67 |
| V @ 40° C., cS | 57.46 | 58.56 | 43.54 | 56.78 | 42.68 |
| VI | 167 | 171 | 146 | 153 | 150 |
| V @ 150° C., cP | 3.27 | 3.38 | 2.49 | 3.03 | 2.51 |
| HTHSR, cP** | 3.16 | 3.41 | 2.6 | 2.98 | 2.44 |
| % Viscosity Retained*** | 97 | 100.9 | 104.4 | 98.3 | 97.2 |

*This sample is an ethylene-propylene polymer Paratone 855, available from Exxon Chemical Co.
**HTHSR is for high temperature (150° C.) high shear rate ($10^6$ $sec^{-1}$).
***% shear stability = 100 × [HTHSR (in cP)/$V_{150° C.}$ (in cP)]

EXAMPLE 13

Viscosity Improving Properties of EPCs

The EPC 1 to EPC 4 samples synthesized in Example 12 were very effective in improving the lube viscosities and VIs of a low viscosity oil (Table 6). These VI improved oils had better shear stabilities than the oils improved with commercial VI improvers. For example, when 5 wt % of the EPC synthesized in Example 12 was blended with PAO synthetic lube from 1-decene, the products have higher retained high temperature high shear rate (HTHSR) viscosity (97–100%) than the blend with a commercial EPC VI improver (97%) (Table 6). Furthermore, these blends have higher viscosities and VI. The 7.67 cS blend using EPC-2 as VI improver has 104% shear stability versus 97% shear stability for the comparative example of similar viscosity.

EXAMPLE 14

Formulations and viscometrics of Crossgrades with EPC samples or commercial EPO VI improvers The EPC products synthesized in Example 12 were formulated into crossgraded engine oils by blending with low viscosity PAO, synthetic dibasic ester and an additive package containing dispersant, detergent, antioxidant and antiwear components. The SAE viscosity grades, viscosities, low temperature properties and shear stabilities of the formulated oils, Blend A to F, were summarized in Table 7.

Similarly, two commercial VI improvers were used in the formulation of crossgraded engine oils. The properties of the blended products, Blend G to L, are summarized in Table 8.

The data in Tables 7 and 8 demonstrated that EPC samples synthesized in Example 12 had better shear stabilities than commercial products. For example the 5W-30 oil from EPC-2 (Blend C) had 100% shear stability. However, the 5W-30 oils from commercial VII, Blend G and J, had only 93 and 94% shear stability. The 10W-50 oil from EPC-2, Blend D, had 96.5% shear stability versus 81.5% and 82.6% for the 10W-50 oils from commercial VII, Blend I and L.

The EPC VI improver synthesized in this invention had higher shear stability than the commercial products. The EPC VII was produced by the $Cr/SiO_2$ catalyst in high yield. It can be one member of the family of lubricant products from the flexible $Cr/SiO_2$ technology.

TABLE 7

FORMULATIONS AND VISCOMETRICS OF CROSSGRADES, USING EPC AS VI IMPROVER IN A TYPICAL SYNTHETIC ENGINE OIL FORMULATION.

| | EPC-1 | | EPC-2 | | EPC-3 | |
|---|---|---|---|---|---|---|
| Blend No. | A | B | C | D | E | F |
| SAE Viscosity Grade | 10W-30 | 15W-50 | 5W-30 | 10W-50 | 10W-30 | 20W-50 |
| PAO Basestock (%) | 63.35 | 59.35 | 63.35 | 58.55 | 61.35 | 53.95 |
| EPC-1 | 3% | 7% | — | — | — | — |
| EPC-2 | — | — | 3% | 7.8% | — | — |
| EPC-3 | — | — | — | — | 5% | 12.4% |
| Dibasic Ester | 20% | 20% | 20% | 20% | 20% | 20% |
| Additive | 13.65% | 13.65% | 13.65% | 13.65% | 13.65% | 13.65% |
| V @ 40° C., cS | 62.2 | 108.5 | 59.8 | 111.0 | 63.7 | 130.2 |
| V @ 100° C., cS | 10.38 | 16.77 | 10.06 | 16.79 | 10.3 | 17.94 |
| VI | 156 | 168 | 156 | 165 | 149 | 153 |
| CCS at −15° C., P | — | 25.3 | — | — | — | 44.4 |
| CCS at −20° C., P | 23.28 | — | — | 34.0 | 28.5 | — |
| CCS at −25° C., P | — | — | 34.0 | — | — | — |
| HTHSR, cP | 3.38 | 4.82 | 3.31 | 5.02 | 3.41 | 5.47 |
| Calc.cP @ 150° C. | 3.41 | 5.27 | 3.3 | 5.2 | 3.34 | 5.47 |
| Percent (%) Shear Stable | 99.1 | 91.5 | 100.3 | 96.54 | 102.1 | 100.0 |

TABLE 8

VISCOMETRICS OF CROSSGRADES VI IMPROVERS IN A TYPICAL SYNTHETIC FORMULATION.

| | Commercial VI Improver* | | | Commercial VI Improver | | |
|---|---|---|---|---|---|---|
| Blend NO. | G | H | I | J | K | L |
| SAE Vis. | 5W-30 | 5W-40 | 10W-50 | 5W-30 | 5W-40 | 52.35% |
| PAO Base | 61.35% | 56.35% | 52.35% | 61.35% | 56.35% | 52.35% |
| VII* | 5% | 10% | 14% | — | — | — |
| VII* | — | — | — | 5% | 10% | 14% |
| Ester | 20% | 20% | 20% | 20% | 20% | 20% |
| Additive | 13.65% | 13.65% | 13.65% | 13.65% | 13.65% | 13.65% |
| V @ 40° C. cS | 56.8 | 81.6 | 109.5 | 58.5 | 86.6 | 114.6 |
| V @100 ° C. cS | 9.76 | 13.2 | 17.1 | 9.84 | 13.5 | 17.7 |
| VI | 158 | 164 | 171 | 154 | 159 | 171 |
| CCS/ −15° C., P | 16.9 | 19.4 | 21.1 | 17.2 | 19.9 | 23.3 |
| CCS/ −20° C., P | 27.7 | 31.4 | — | 28.0 | 32.8 | — |
| HTHSR, cP | 2.99 | 3.72 | 4.31 | 3.08 | 3.8 | 4.55 |
| Calc.cP @ 150° C. | 3.22 | 4.27 | 52.9 | 3.27 | 4.38 | 5.51 |
| Percent (%) Shear Rate | 92.9% | 87.1% | 81.5% | 94.2% | 86.8% | 82.6% |

*Texaco Co.

The VI improver (VII) described in this invention is different and better than HVI-PAO VI improver produced in US patent 5,012,020. The EPC VII have more viscosity boosting power than the HVI-PAO of comparable molecular size.

EXAMPLE 15

When a HVI-PAO of 8,000 molecular weight, produced according to the methos of U.S.Pat.No. 5,012,020 is blended at 5 weight percent with commercial PAO prepared from oligomerizatiom of 1-decene using $BF^3$ catalyst and the resulting lubricant properties compared to those from EPC-1 to EPC-4 of the instant invention the following results are produced:

TABLE 9

| VI Improver | EPC-1 | EPC-2 | EPC-3 | EPC-4 | HVI-PAO |
|---|---|---|---|---|---|
| Mole. Wgt. by GPC | | | | | |
| $MW_n$ | 4884 | 6514 | 3993 | 8111 | 8072 |
| $MW_w$ | 13921 | 16441 | 10764 | 22053 | 20990 |
| MWD | 2.85 | 2.52 | 2.74 | 2.72 | 2.60 |
| Product Properties of Blends, 5 Wt. % in commercial PAO | | | | | |
| V @ 100° C., cS | 10.2 | 10.5 | 7.67 | 9.58 | 7.70 |
| V @ 40° C., cS | 57.46 | 58.56 | 43.54 | 56.78 | 43.40 |
| VI | 167 | 171 | 146 | 153 | 148 |

As the above Example shows, the blend from HVI-PAO of 8000 MW has a 100° C. viscosity of 7.7 cS, which is much lower than the 100° C. viscosity (9.58 cS) from EPC-4 sample of comparative molecular weight. EPC-1 and EPC-2 has 4884 and 6514 MW, which is lower than the MW of HVI-PAO. However, the blends from these EPC samples have 10.2 and 10.5 cS higher than the HVI-PAO derived blend. These comparisons demonstrate that the EPC VI improver has unexpectedly better VI and viscosity boosting power than HVI-PAO.

Compared to low MW EPC basestock as prepared in U.S. Pat. No. 4990709, the VI improvers in this invention produce formulated engine oils with unexpectedly better low temperature viscometrics. These new VI improvers permit the formulation of wider cross-graded engine oil which is not achievable with low MW EPC.

EXAMPLE 16

EPC basestock (92 cS), prepared according to U.S. Pat. No. 4,990,709, was blended in a formulation according to that described in Example 14, Table 7. The blend properties are summarized in the following Table 16.

TABLE 16

| Blend No. | M | N | O | P | Q |
|---|---|---|---|---|---|
| PAO Basestock, Wt % | 61.36 | 56.35 | 51.35 | 46.35 | 41.35 |
| EPC Basestock per US4990709, wt % | 5 | 10 | 15 | 20 | 25 |
| Dibasic ester, wt % | 20 | 20 | 20 | 20 | 20 |
| Additives, wt % | 13.65 | 13.65 | 13.65 | 13.65 | 13.65 |
| V @ 100° C., cS | 8.62 | 10.35 | 12.31 | 14.85 | 17.64 |
| V @ 40° C., cS | 50.97 | 62.78 | 79.55 | 99.46 | 123.41 |
| VI | 147 | 153 | 152 | 156 | 158 |
| CCS @ −15° C., P | — | — | — | — | 43.89 |
| CCS @ −20° C., P | — | 28.56 | — | — | 71.47 |
| CCS @ −25° C., P | — | 48.28 | — | — | — |

These results show that blends N or Q have higher CCS viscosity than blends C or D at −15° to −25° C. As a result, blends N or Q cannot be formulated into 5W30 or 10W50 oils, because the maximum CCS viscosity specification for 5W or 10W oils is 35 P at −25° C. or at −20° C. These blends show that the VII of the instant invention is better than the low viscosity EPC basestock.

While the invention has been described by reference to specific embodiments there is no intent to limit the scope of the invention except to describe in the following claims.

What is claimed is:

1. A liquid hydrocarbon lubricant viscosity index improver composition having high shear stability comprising homopolymer or copolymer product of the oligomerization of $C_3$ to $C_5$ alpha-olefin or mixtures thereof, with or without ethylene as comonomer, under oligomerization conditions in contact with a reduced valence state Group VIB metal catalyst on porous support, said viscosity index improver having a regio-irregularity of at least 20%, weight average molecular weight between 6,000 and 30,000 and molecular weight distribution between 2 and 5.

2. The composition of claim 1 wherein said product comprises the oligomerization residue of at least one $C_3$ to $C_5$ alpha olefin with ethylene.

3. The composition of claim 1 comprising the oligomerization product of propylene and ethylene.

4. The composition of claim 3 wherein the molar ratio of propylene to ethylene is from 100:1 to 0.1:1.

5. The composition of claim 4 wherein the molar ratio of propylene to ethylene is from 10:1 to 1:1.

6. The composition of claim 1 having an average molecular weight between 10,000 and 25,000.

7. The composition of claim 1 wherein the catalyst comprises reduced chromium oxide on a porous support.

8. The composition of claim 7 wherein said porous support comprises silica.

9. The composition of claim 1 wherein said oligomerization conditions comprise temperature between 0° C. and 250° C.

10. The composition of claim 9 wherein said oligomerization conditions comprise temperature between 90° C. and 250° C.

11. The composition of claim 9 wherein said oligomerization conditions comprise temperature between 90° C. and 100° C.

12. The composition of claim 3 having a viscosity not greater than 75 cS, measured at 100° C.

13. A process for the production of liquid hydrocarbon lubricant viscosity index improver having high shear stability comprising reacting $C_3$ to $C_5$ alpha-olefin or mixtures thereof, with or without ethylene, under oligomerization conditions in contact with a reduced valence state Group VIB metal catalyst on porous support, whereby said viscosity index improver is produced having a regio-irregularity of at least 20%, weight average molecular weight between 6,000 and 30,000 and molecular weight distribution between 2 and 5.

14. The process of claim 13 wherein said product comprises the oligomerization product of propylene and ethylene at a molar ratio of propylene to ethylene from 100:1 to 0.1:1.

15. The process of claim 14 wherein said product comprises the oligomerization product of propylene and ethylene at a molar ratio of propylene to ethylene from 10:1 to 1:1.

16. The process of claim 13 wherein said catalyst comprises reduced chromium oxide on porous support and said oligomerization conditions comprise temperature between 0° C. and 250° C.

17. A high shear stable liquid lubricant composition comprising a blend of hydrocarbon lubricant basestock and viscosity index improving amount of the composition according to claim 1.

18. The composition of claim 17 containing between 2 and 25 percent of the composition of claim 1.

19. The composition of claim 17 having a shear stability of at least 97%.

20. The composition of claim 17 wherein said basestock comprises mineral oil.

21. The composition of claim 17 wherein said basestock comprises polyalpha-olefins.

* * * * *